US006332307B1

(12) United States Patent
Friedson

(10) Patent No.: US 6,332,307 B1
(45) Date of Patent: Dec. 25, 2001

(54) COLLAPSIBLE SADDLE ASSEMBLY

(76) Inventor: Ronald S. Friedson, 95 Bayberry La., Westport, CT (US) 06880

( * ) Notice: Subject to any disclaimer, the term of this patent is extended or adjusted under 35 U.S.C. 154(b) by 0 days.

(21) Appl. No.: 09/228,593

(22) Filed: Jan. 12, 1999

(51) Int. Cl.[7] ..... B68C 1/08; B68C 1/02
(52) U.S. Cl. ..... 54/44.6; 54/44.5
(58) Field of Search ..... 54/44.1, 44.5, 54/44.6, 44.7

(56) References Cited

U.S. PATENT DOCUMENTS

| | | | | |
|---|---|---|---|---|
| 753,751 | * | 3/1904 | Stern | 54/44.6 |
| 2,008,977 | * | 7/1935 | Connolly | 54/44.1 |
| 3,624,695 | | 11/1971 | Roberts, Jr. . | |
| 4,287,705 | | 9/1981 | Frost et al. . | |
| 4,414,791 | | 11/1983 | Freeze . | |
| 4,502,266 | | 3/1985 | Friedson . | |
| 4,524,570 | | 6/1985 | Racinet | 54/66 X |
| 4,771,590 | | 9/1988 | Bates . | |
| 4,800,709 | | 1/1989 | Le Tixerant | 54/44.1 |
| 4,860,524 | | 8/1989 | Dumoulin et al. . | |
| 4,879,865 | | 11/1989 | Van Scoyk | 54/66 |
| 4,965,988 | | 10/1990 | Anderson . | |
| 5,685,133 | | 11/1997 | Travis | 54/44.7 |
| 5,799,473 | | 9/1998 | Goblet | 54/44.1 |

FOREIGN PATENT DOCUMENTS

| | | | | |
|---|---|---|---|---|
| 2071986 | * | 9/1981 | (GB) | 54/44.1 |

* cited by examiner

*Primary Examiner*—Robert P. Swiatek
(74) *Attorney, Agent, or Firm*—Nixon Peabody LLP; Tim L. Brackett, Jr.

(57) ABSTRACT

A saddle assembly comprising a seat portion with panels detachably mounted thereto, one on each of the opposing sides. An under flap and a long flap are detachably secured to each panel, the long flap overlying the under flap. The panels and long flaps each have cooperating fasteners for detachably securing the under flaps and long flaps to the respective panels. Each panel includes a cavity for receiving a filler material. The cavity has an access opening suitably configured for adding and removing material from the cavity, and fasteners across the opening for retaining the material in the cavity. Alternatively, the panel includes an inflatable cavity with a valve for controlling the passage of fluid to and from the cavity.

24 Claims, 8 Drawing Sheets

COLLAPSIBLE SADDLE ASSEMBLY

BACKGROUND OF THE INVENTION

The present invention relates generally to seating apparatus and more particularly to a novel saddle assembly for horse-back riding or the like.

Conventional horse saddles, such as English saddles, include a frame or tree mounting a seat upon which the rider sits and, on each of the left and right sides of the seat, a panel, an under or sweat flap, and a long flap affixed to the tree. Traditional construction has included natural leather or synthetic materials, the flaps and panels being stitched or otherwise permanently bound to the tree. This simple, reliable arrangement has undergone few modifications for hundreds of years.

With the advent of modem transportation, the use of horses and other pack animals has changed from transportation to general sports and recreation. This trend has, in turn, defined new problems and needs to be fulfilled by saddles. A principal issue for competitive riders, for instance, has been the difficulty in transportation of saddles to and from horse shows. Their sheer size, bulk, and rigidity has made their transportation, particularly air travel, costly and cumbersome.

SUMMARY OF THE INVENTION

It is therefore an object of the present invention to provide a saddle assembly which is both simple and economical to store and transport.

Another object of the present invention is to provide a saddle assembly which can be readily assembled, disassembled, and reassembled repeatedly for storage or transportation.

A further object of the present invention is to provide a durable and reliable saddle assembly which is simple and convenient to use, store or transport.

Still another object of the present invention is to provide a simple, economical method of assembling, disassembling, and reassembling a saddle assembly for storage or transportation.

In accordance with one aspect of the present invention is a saddle assembly which comprises a seat portion with optional skirts secured to opposing sides thereof, panels detachably mounted to the seat portion, one on each of the opposing sides and preferably underlying the respective skirt, an under flap underlying each skirt and detachably secured between the respective panel and skirt, and a long flap overlying each under flap and detachably secured to the respective panel, the panels and long flaps each having cooperating fasteners for detachably securing the under flaps and long flaps to the respective panels, each panel including a cavity for receiving a filler material, the cavity having an access opening suitably configured for adding and removing the material therefrom, and fasteners across the opening for retaining the material in the cavity.

In accordance with another aspect of the present invention is a saddle assembly which comprises a seat portion optionally having skirts secured to opposing sides thereof, panels detachably mounted to the seat portion, one on each of the opposing sides and preferably underlying the respective skirt, an under flap underlying each skirt and detachably secured between the respective panel and skirt, and a long flap overlying each under flap and detachably secured to the panel, the panels and long flaps each having cooperating fasteners for detachably securing the under flaps and long flaps to the respective panels, each panel including an inflatable cavity with a valve for controlling the passage of fluid to and from the cavity.

According to a further aspect of the present invention is a method of assembling a saddle which comprises the steps of:

(i) providing a saddle seat portion, (ii) detachably securing panels to opposing sides of the seat portion, one panel to each side, (iii) detachably securing under flaps to the panels, one under flap to each panel, and (iv) detachably securing long flaps to the panels, over the under flap, one long flap to each panel, the panels each having front and rear faces, the rear face including fasteners for detachably mounting the panel to the seat portion and the front face having fasteners for detachably securing the corresponding under flaps and long flaps to opposing sides of the respective panels, each panel including a cavity for receiving a filler material, the cavity having an access opening suitably configured for adding and removing the material therefrom, and fasteners across the opening for retaining the material in the cavity.

In accordance with another aspect of the present invention is a method of disassembling a saddle, which comprises the steps of:

(i) detaching fasteners securing an access opening in a saddle panel, the opening leading to a cavity for receiving a filler material, the panel underlying an under flap and a long flap detachably secured thereto, (ii) removing the material from the cavity, (iii) detaching the panel from a saddle seat portion, (iv) detaching the under flap and the long flap from the panel, (v) separating the panel from the seat portion, and the under flap and long flap from the panel, and (vi) flattening the panel, under flap, long flap, and seat portion for transportation.

According to yet another aspect of the present invention is a method of assembling a saddle having an inflatable panel, which comprises the steps of:

(i) providing a saddle seat portion, (ii) detachably securing panels to opposing sides of the seat portion, one panel to each side, (iii) detachably securing under flaps to the panels, one under flap to each panel, (iv) detachably securing long flaps to the panels, over the under flap, one long flap to each panel, the panels each having front and rear faces, the rear face including fasteners for detachably mounting the panel to the seat portion and the front face having fasteners for detachably securing the corresponding under flap and long flap to the panel, and (v) inflating the panel, the panel including an inflatable cavity with a valve for controlling the passage of fluid to and from the cavity.

According to still another aspect of the present invention is a method of disassembling a saddle having an inflatable panel, which comprises the steps of:

(i) deflating a saddle panel overlapping under and long flaps, the panel including an inflatable cavity with a valve for controlling the passage of fluid to and from the cavity, (ii) detaching the panel from a saddle seat portion, (iii) detaching the under flap and the long flap from the panel, (iv) separating the panel from the seat portion, and the under flap and long flap from the panel, and (v) flattening the panel, under flap, long flap, and seat portion for transportation.

In accordance with another aspect of the present invention is a saddle assembly comprising a seat portion, panels detachably mounted to the seat portion, one panel to each opposing side thereof, under flaps detachably secured to the panels, one to each panel, and long flaps overlying the respective under flaps and detachably secured one to each panel, the panels and long flaps having cooperating fasteners for detachably securing the under flaps and long flaps to corresponding panels, each panel further including a cavity for receiving a filler material, the cavity having an access opening suitably configured for adding and removing the material therefrom, and fasteners across the opening for retaining the material in the cavity.

According to a further aspect of the present invention is an English saddle assembly which comprises a seat portion, panels detachably mounted to the seat portion, one panel to each opposing side thereof, under flaps detachably secured to the panels, one to each panel, and long flaps overlying the respective under flaps and detachably secured to each panel, the panels and long flaps having cooperating fasteners for detachably securing the under flaps and long flaps to corresponding panels, each panel further including an inflatable cavity with a valve for controlling the passage of fluid to and from the cavity. Alternatively, the panel includes an inflatable cavity with a valve for controlling the passage of fluid to and from the cavity.

In accordance with a further aspect of the present invention is a western saddle assembly comprising a seat portion, skirts detachably mounted to the seat portion, one skirt to each opposing side thereof, and long fenders detachably secured one to each skirt, the skirts and fenders having cooperating fasteners for detachably securing the fenders to corresponding skirts, each skirt further including a cavity for receiving a filler material, the cavity having an access opening suitably configured for adding and removing the material therefrom, and fasteners across the opening for retaining the material in the cavity. Alternatively, the skirt includes an inflatable cavity with a valve for controlling the passage of fluid to and from the cavity.

Although the present invention is shown and described in connection with equestrian saddles, its application to other seating apparatus is understood, within the spirit and scope of the present invention.

The present invention will now be further described with reference to the following drawings which are not intended to limit the accompanying claims.

BRIEF DESCRIPTION OF THE DRAWINGS

The same numerals are used throughout the drawing figures to designate similar elements. Still other objects and advantages of the present invention will become apparent from the following description of the preferred embodiments.

DETAILED DESCRIPTION OF THE PREFERRED EMBODIMENTS

Figure 1:
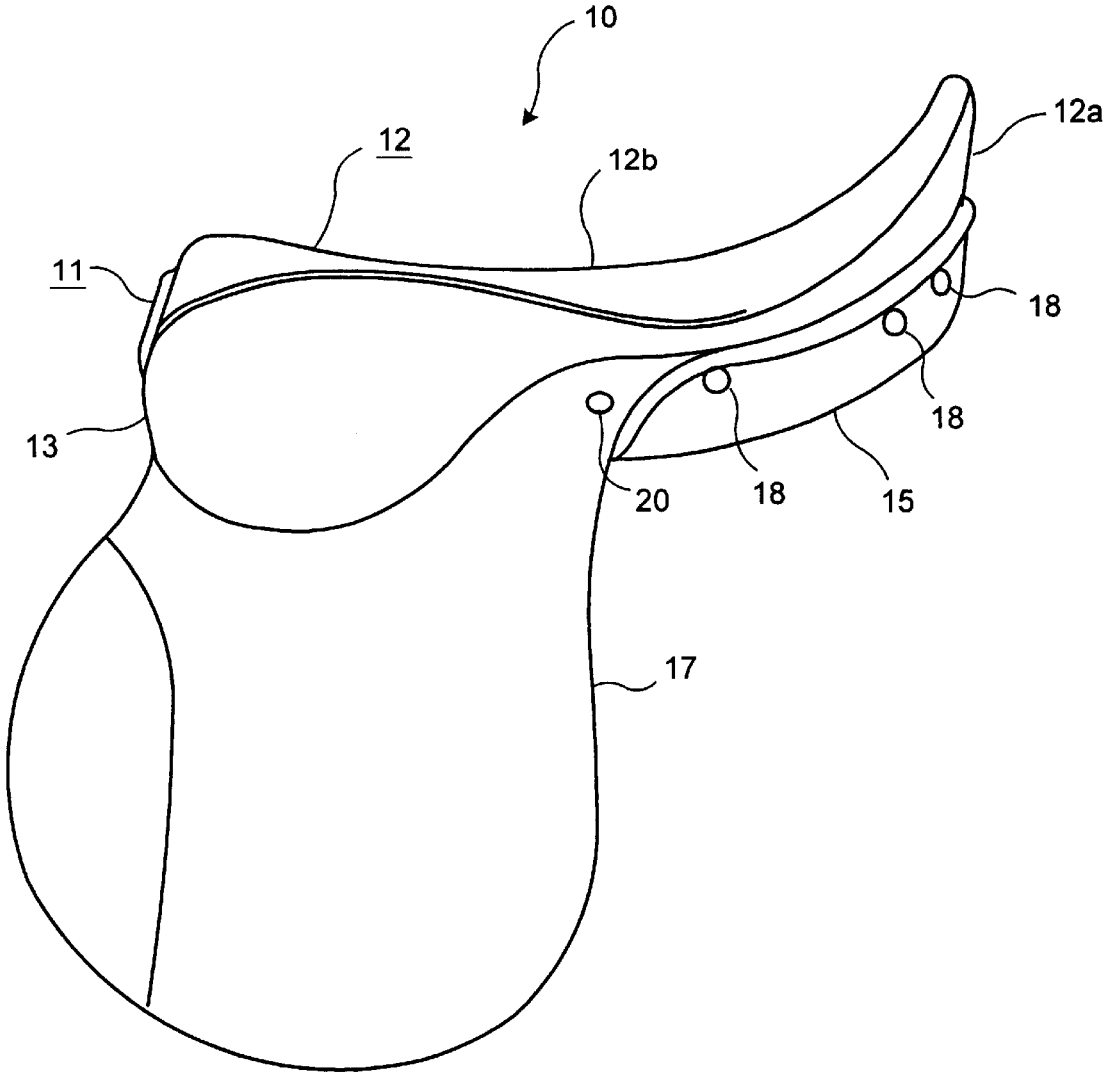
FIG. 1 is a plan view of a saddle assembly according to one aspect of the present invention.
Figure 2:
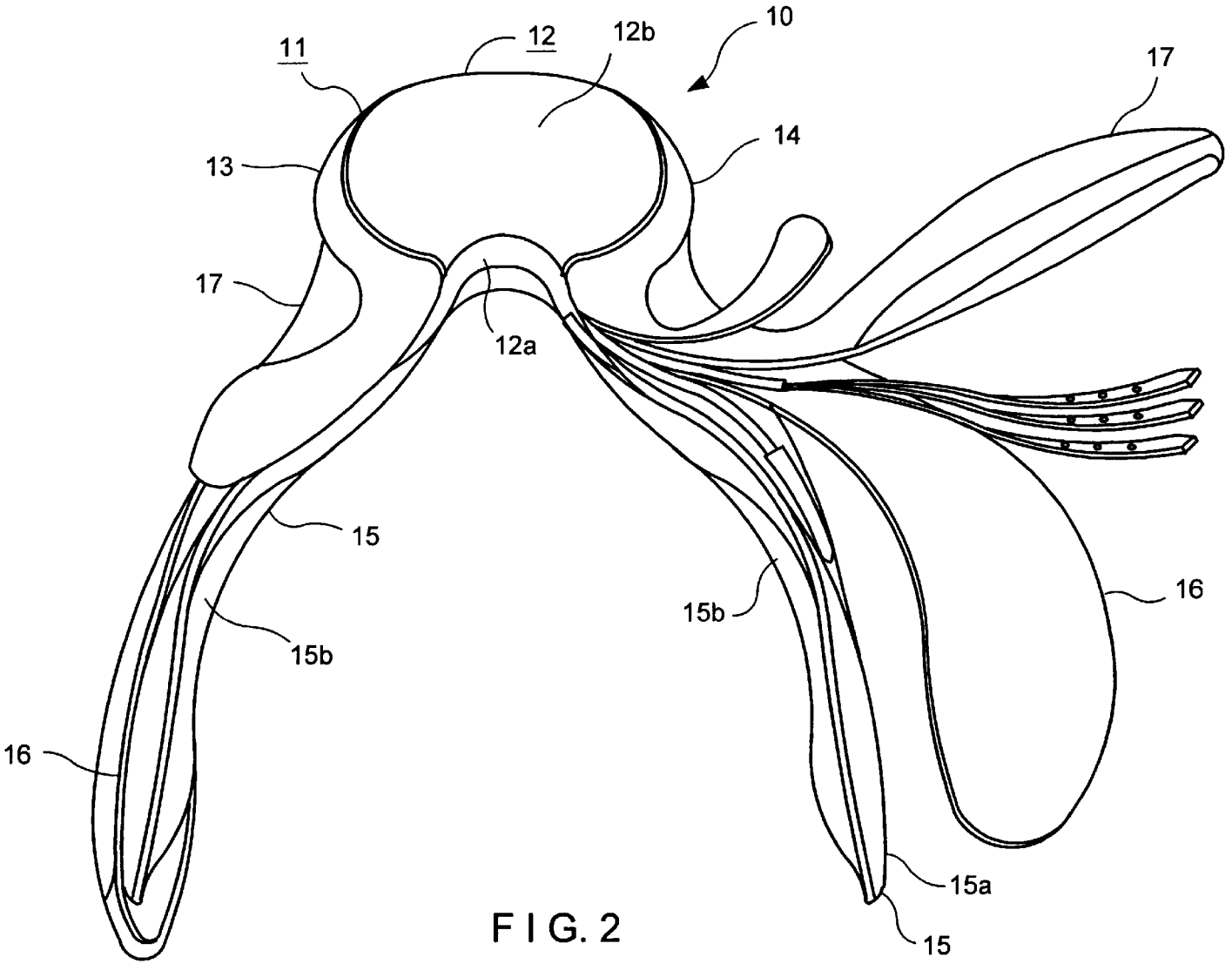
FIG. 2 is a front view of the assembly shown in FIG. 1.
Figure 3:
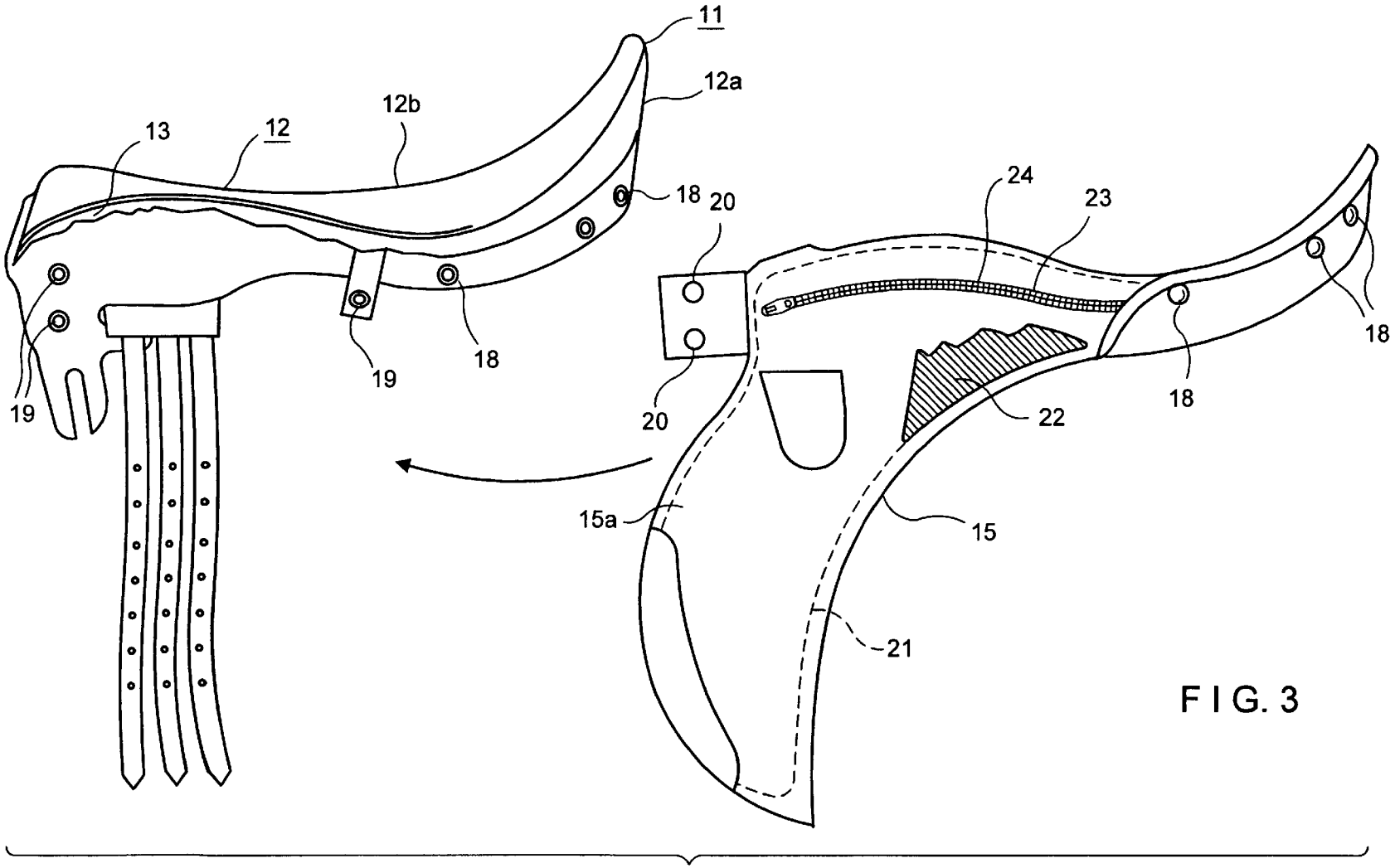
FIG. 3 is an exploded view of the panel and assembly shown in FIG. 1.
Figure 4:
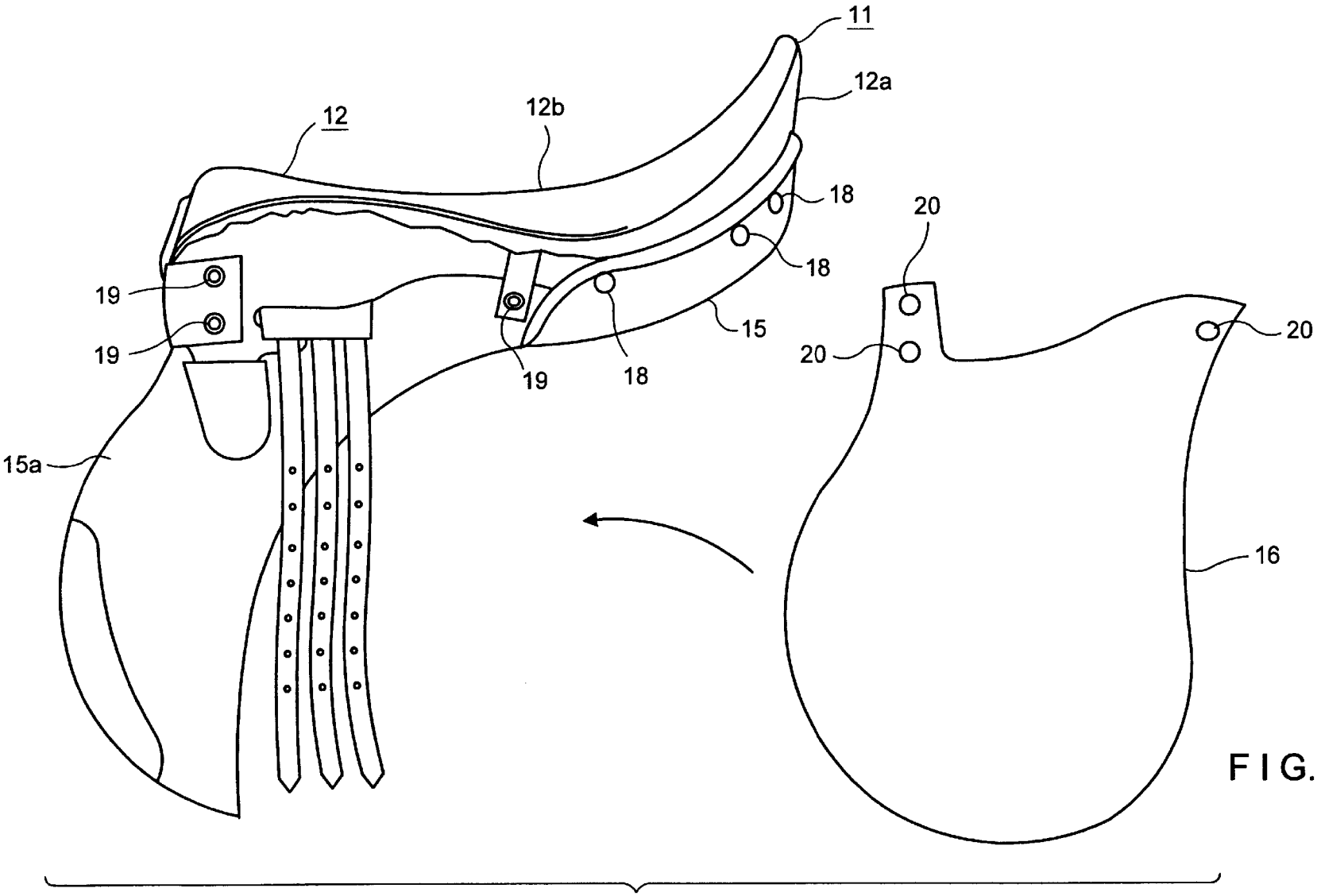
FIG. 4 is an exploded view of the under flap and assembly shown in FIG. 1.
Figure 5:
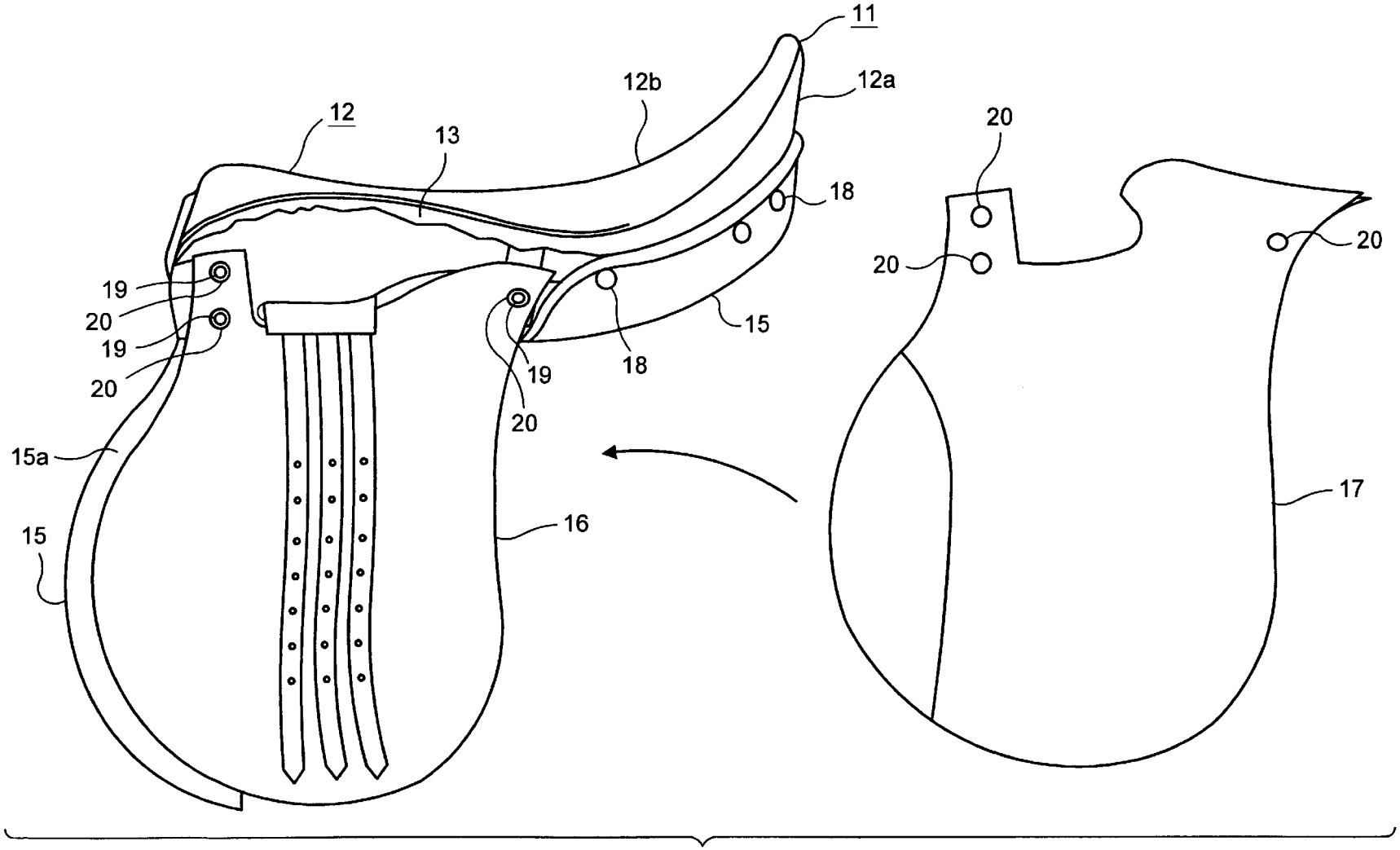
FIG. 5 is an exploded view of the long flap and assembly shown in FIG. 1.
Figure 6:
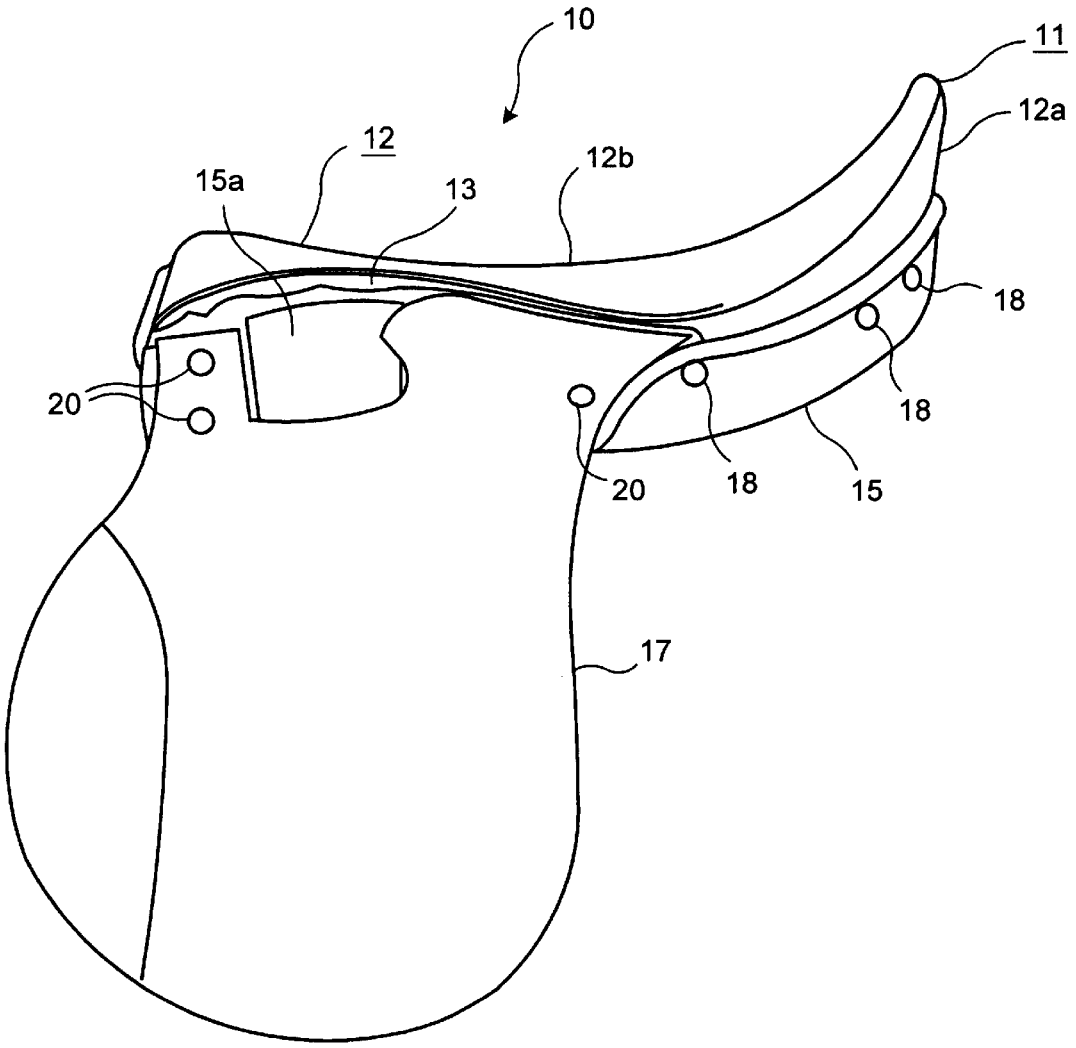
FIG. 6 is a cut-away plan view of the assembly shown in FIG. 1.

Referring now to the drawings and more particularly to FIGS. 1–8, there is shown a collapsible saddle assembly 10 according to various aspects of the present invention. According to one embodiment, a saddle 11 is provided having a seat portion 12 with optional skirts 13, 14 secured to opposing sides thereof. The seat portion preferably includes a frame or tree 12*a* with a seat 12*b* mounted (detachably or permanently) to and covering the tree. As best seen in FIGS. 2–6, panels 15 are detachably secured to the seat portion, one on each of the opposing sides, and preferably underlying skirts 13, 14, respectively. An under or sweat flap 16 underlying each skirt and a long flap 17 overlying each under flap are detachably secured to the seat portion and the panel.

The panel comprises a generally rigid, pistol-shaped member with front and rear faces 15*a,* 15*b,* respectively, configured for fitting engagement with the seat portion and other saddle components. Mounting fasteners 18, such as snaps, Velcro®, press-studs, zerts, Chicago fasteners or the like, are provided preferably on the panel rear face with cooperating fasteners on the seat for detachably securing the panel and seat portion to one another. On the front face of the panel, a plurality of fasteners 19 are provided for releasably securing each of the under and long flaps thereto. The fasteners desirably pass through corresponding holes 20 in each of the under and long flaps so as to secure them to the saddle. Suitable fasteners include snaps, Velcro®, press-studs, zerts, Chicago fasteners or the like. Alternatively or concurrently therewith, each of the under and/or long flaps are provided with fasteners for mating engagement with cooperating fasteners on the panel and skirt.

It is preferred that the panel also be provided with a pocket for receiving a fin extending from the seat lower portion. Upon engagement of the fin with the pocket, and mounting fasteners 18 on the panel and seat portion, a flap extending from the panel forward end is wrapped over the fin. Holes in the flap are engaged with fasteners 19 to aid in securement of the panel to the seat portion, i.e., upon securing the under and long flaps to the panel. Preferably, another fastener 19 is provided on a seat flap proximate the seat rear end for engaging cooperating fasteners on the long flap, again to aid in securing the under and long flaps to the panel.

The panel includes a cavity 21 for receiving a filler material 22, such as wool stuffing, Confor®, polyurethane or the like. An access opening 23 in the cavity is suitably configured for ready insertion or removal of the material. Suitable fasteners 24, e.g., snaps, Velcro® or a zipper, are provided along the opening for retaining the material in the cavity. This feature advantageously provides for ready insertion or removal of filler materials without special skills or tools.

Figure 7:
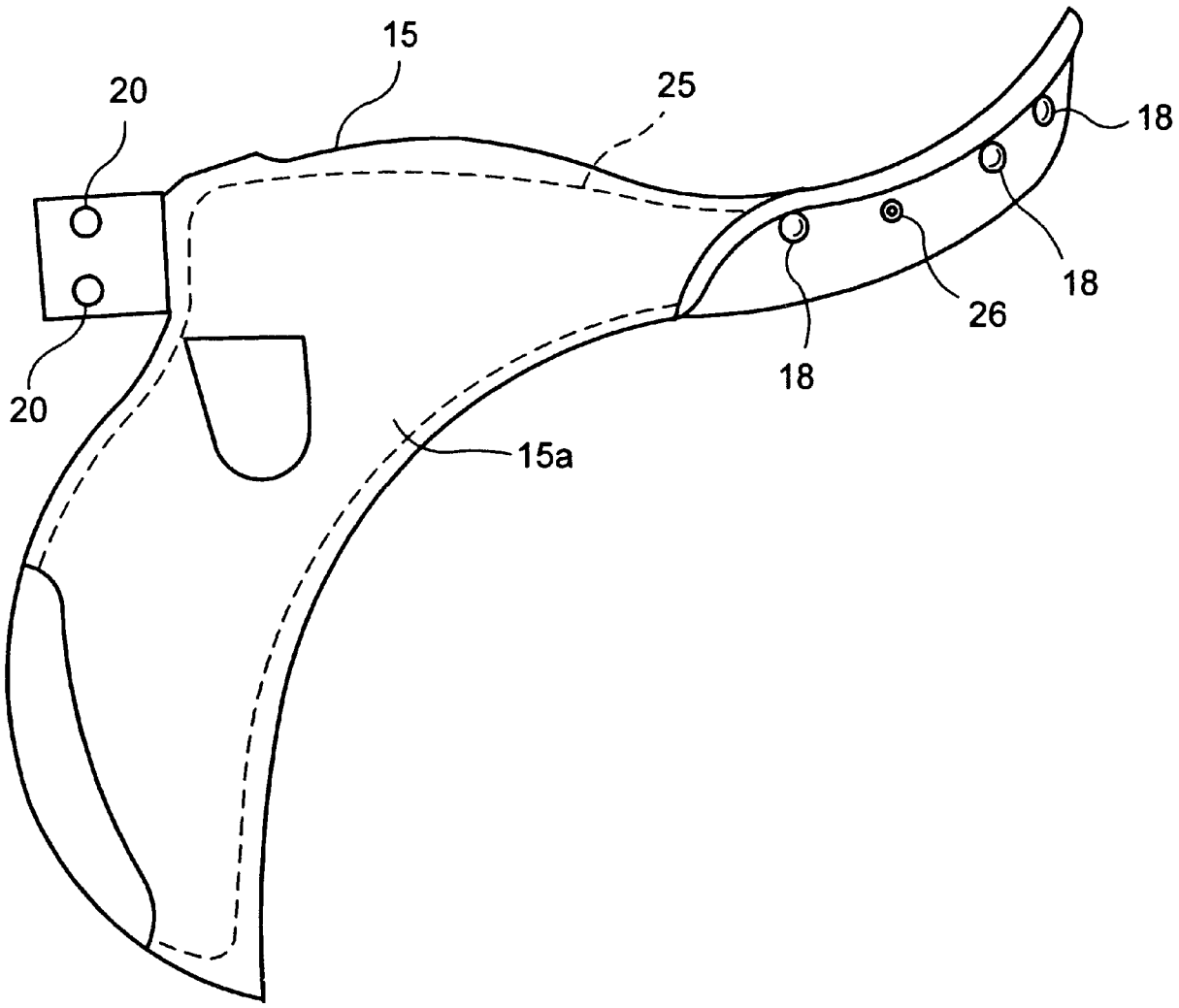
FIG. 7 is a plan view of the underside of the panel shown in FIG. 1.

Alternatively or concurrently therewith, as shown in FIG. 7, the panel cavity includes an inflatable bladder 25 or the like with a valved opening 26, e.g., a standard Schraeder-type valve, for selectively controlling the passage of a fluid such as air to and from the cavity. Upon insertion of a pump adapter (not shown), e.g., of a conventional pump, in the valve and actuating the pump, the panel may be inflated to a selected size. A bleed valve (not shown) may be provided in conjunction with the valve, or separately therefrom, for selected deflation to accommodate a different user or equestrian application. Overall, it is preferred that the assembly be constructed of conventional materials such as leather, a synthetic such as nylon, or the like, depending on the intended application and user preference.

Figure 8:
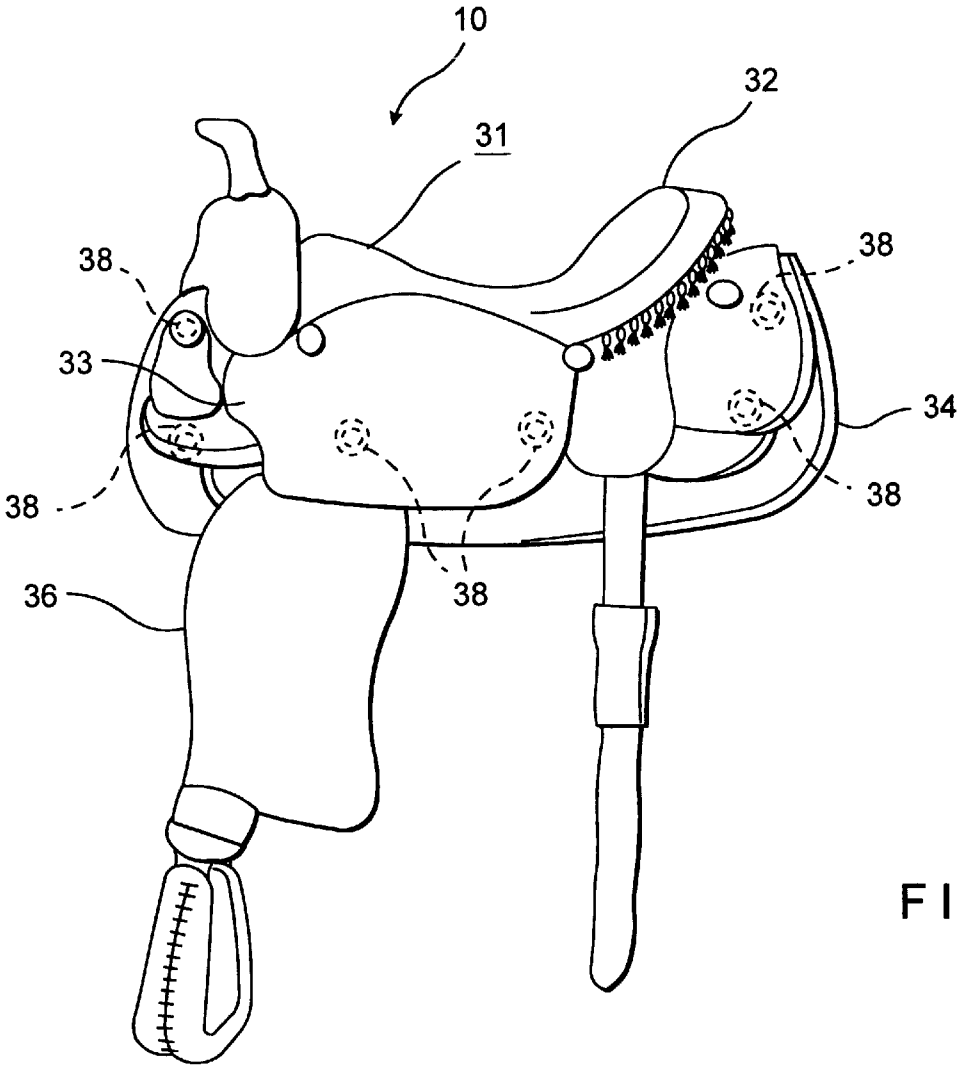
FIG. 8 is a plan view of a saddle assembly according to another aspect of the present invention.

A further embodiment of the present invention is provided in FIG. 8, which shows a saddle 31 commonly known as a western saddle. The saddle has a seat portion 32 with optional jockeys 33 secured to opposing sides thereof. Western skirts 34 are detachably secured to the seat portion, one on each of the opposing sides, and preferably underlying the jockeys. Long fenders 36 overlying each skirt are also detachably secured to the skirt on each opposing side of the saddle.

In the manner generally described above in connection with English saddles and the like, mounting fasteners 38, such as snaps, Velcro®, press-studs, zerts, Chicago fasteners or the like are provided for detachably securing the western skirt to the seat portion. Other features of western saddles are considered known to those skilled in the art and further discussion is believed unnecessary for purposes of illustrating the present invention.

Although the present invention is shown and described in connection with saddles for horseback riding, its application to other seating apparatus is understood, giving consideration to the purpose for which the present invention is intended. Likewise, saddle types and styles other than those presented herein, e.g., treeless saddles, are considered within the spirit and scope of the present invention.

According to a further aspect of the present invention is a method of assembling a saddle, e.g., an English saddle. First, a saddle seat portion is provided, the seat portion optionally having skirts secured to opposing sides thereof. Each of two panels is then detachably secured to the opposing sides and preferably underneath each skirt, one panel to each side. Each panel has front and rear faces, the rear face being equipped with fasteners for detachably mounting the panel to the seat portion and the front face including fasteners for detachably securing the panels, the under flaps and the long flaps to one another. Next, under flaps are detachably secured to the panels between the panel and optional skirt, one under flap to each panel. Finally, the long flaps are secured detachably, one to each panel, over the corresponding under flaps and preferably between the panel and skirt. As above, the panel further includes a cavity for receiving a filler material. The cavity has an access opening suitably configured for adding and removing the material therefrom. Fasteners are provided across the opening for retaining the material in the cavity.

For disassembly of the saddle, the fasteners securing the access opening are first detached, and the filler materials removed from the panel cavity. Next, fasteners on each panel front face are detached from the under flaps and long flaps, and mounting fasteners on the panel rear faces are detached from the seat portion. Each component of the assembly, namely the seat portion, and pairs of panels, under flaps and long flaps, is then separated from one another and the saddle, and flattened for transport, such as in a suitcase or the like. Re-assembly is accomplished by repeating the method steps for assembling a saddle, as set forth above.

According to yet another aspect of the present invention is a method of assembling a saddle having an inflatable panel. First, a saddle seat portion is provided, the seat portion optionally having skirts secured to opposing sides thereof. Each of two panels are then inflated, the panels each having an inflatable cavity with a valve for controlling the passage of fluid to and from the cavity. Next, the panels are detachably secured to the opposing sides and preferably underneath each skirt, one panel to each side. Each panel has front and rear faces, the rear face being equipped with fasteners for detachably mounting the panel to the seat portion and the front face including fasteners for detachably securing the panels, the under flaps and the long flaps to one another. Next, under flaps are detachably secured to the panels between the panel and skirt, one under flap to each panel. Finally, the long flaps are secured detachably, one to each panel, over the corresponding under flaps and between the panel and skirt.

For disassembly of the inflatable panel version, the saddle panel is first deflated using the bleed valve or the like. Next, fasteners on each panel front face are detached from the under flaps and long flaps, and mounting fasteners on the panel rear faces are detached from the seat portion. Each component of the assembly, namely the seat portion, and pairs of panels, under flaps and long flaps, are then separated from one another and from the saddle, and flattened for transport, such as in a suitcase or the like. Re-assembly is, again, accomplished by repeating the method steps for assembling a saddle having an inflatable panel, as set forth above.

According to a further aspect of the present invention is a method of assembling a saddle, e.g., a western saddle. First, a saddle seat portion is provided, the seat portion optionally having jockeys secured to opposing sides thereof. Each of two skirts are then detachably secured to the opposing sides and preferably underneath each jockey, one skirt to each side. Each skirt has front and rear faces, the rear face being equipped with fasteners for detachably mounting the skirt to the seat portion and the front face including fasteners for detachably securing the skirts and long fenders to one another. Finally, the long fenders flaps are detachably secured to the skirts, one to each skirt, preferably between the skirt and jockey.

As above, the skirt includes a cavity for receiving a filler material. The cavity has an access opening suitably configured for adding and removing the material therefrom. Fasteners are provided across the opening for retaining the material in the cavity. Alternatively, the panel includes an inflatable cavity with a valve for controlling the passage of fluid to and from the cavity. Saddle disassembly is accomplished in the same general fashion as described above for purposes of English saddles.

Overall, the present invention advantageously allows ready disassembly and re-assembly of a saddle for ease and convenience in storage and transportation. Its durable and reliable construction allows it to be assembled, disassembled, and reassembled repeatedly for use, storage or transport.

Various modifications and alterations to the present invention may be appreciated based on a review of this disclosure. These changes and additions are intended to be within the scope and spirit of this invention as defined by the following claims.

What is claimed is:

1. A saddle assembly comprising a seat portion, panels detachably mounted to the seat portion, one panel to each opposing side of the seat portion, under flaps detachably secured to the panels, one to each panel, and long flaps overlying the respective under flaps and detachably secured one to each panel, the panels and long flaps having cooperating fasteners for detachably securing the under flaps and long flaps to corresponding panels, each panel further including a cavity for receiving a filler material, the cavity having an access opening suitably configured for adding and removing the material therefrom, and fasteners across the opening for retaining the material in the cavity.

2. The assembly set forth in claim 1 wherein the filler material is foam.

3. The assembly set forth in claim 1 wherein the panel fasteners are snaps.

4. The assembly set forth in claim 1 wherein the panel fasteners are of the hook and loop type.

5. The assembly set forth in claim 1 wherein the opening fasteners include a zipper.

6. The assembly set forth in claim 1 wherein the opening fasteners include the hook and loop type.

7. The assembly set forth in claim 1 wherein at least a portion of the assembly is constructed of a synthetic material.

8. The assembly set forth in claim 1 wherein skirts are secured to opposing sides of the seat portion, the panels underlying the skirts, respectively, and the under flaps underlie each skirt detachably secured between the respective panel and skirt.

9. A saddle assembly which comprises a seat portion, panels detachably mounted to the seat portion, one panel to each opposing side of the seat portion, under flaps detachably secured to the panels, one to each panel, and long flaps overlying the respective under flaps and detachably secured to each panel, the panels and long flaps having cooperating fasteners for detachably securing the under flaps and long flaps to corresponding panels, each panel further including an inflatable cavity with a valve for controlling the passage of fluid to and from the cavity.

10. The assembly set forth in claim 9 wherein the panel fasteners are snaps.

11. The assembly set forth in claim 9 wherein the panel fasteners are of the hook and loop type.

12. The assembly set forth in claim 9 wherein the opening fasteners include a zipper.

13. The assembly set forth in claim 9 wherein the opening fasteners include the hook and loop type.

14. The assembly set forth in claim 9 wherein at least one portion of the assembly is constructed of a synthetic material.

15. The assembly set forth in claim 9 wherein skirts are secured to opposing sides of the seat portion, the panels underlying the skirts, respectively, and the under flaps underlie each skirt detachably secured between the respective panel and skirt.

16. A method of assembling a saddle which comprises the steps of:

(i) providing a saddle seat portion, (ii) detachably securing panels to opposing sides of the seat portion, one panel to each side, (iii) detachably securing under flaps to the panels, one under flap to each panel, and (iv) detachably securing long flaps to the panels, over the under flaps, one long flap to each panel, the panels each having front and rear faces, the rear face including fasteners for detachably mounting the panel to the seat portion and the front face having fasteners for detachably securing the corresponding under flaps and long flaps to the respective panels, each panel including a cavity for receiving a filler material, the cavity having an access opening suitably configured for adding and removing the material therefrom, and fasteners across the opening for retaining the material in the cavity.

17. A method of disassembling a saddle which comprises the steps of:

(i) detaching fasteners securing an access opening in a saddle panel, the opening leading to a cavity for receiving a filler material, the panel underlying an under flap and a long flap detachably secured thereto, (ii) removing the material from the cavity, (iii) detaching the panel from a saddle seat portion, (iv) detaching the under flap and the long flap from the panel, (v) separating the panel from the seat portion, and the under flap and long flap from the panel, and (vi) flattening the panel, under flap, long flap, and seat portion for transportation.

18. A method of disassembling a saddle, which comprises the steps of:

(i) detaching a panel from a saddle seat portion, the panel underlying an under flap and a long flap detachably secured thereto, (ii) detaching the under flap and the long flap from the panel, (iii) detaching fasteners securing an access opening in the panel, the opening leading to a cavity for receiving a filler material, (iv) removing the material from the cavity, and (v) flattening the panel, under flap, long flap, and seat portion for transportation.

19. A method of assembling a saddle having an inflatable panel, which comprises the steps of:

(i) providing a saddle seat portion, (ii) detachably securing panels to opposing sides of the seat portion, one panel to each side, (iii) detachably securing under flaps to the panels, one under flap to each panel, (iv) detachably securing long flaps to the panels, over the under flap, one long flap to each panel, the panels each having front and rear faces, the rear face including fasteners for detachably mounting the panel to the seat portion and the front face having fasteners for detachably securing the corresponding under flap and long flap to the panel, and (v) inflating the panel, the panel including an inflatable cavity with a valve for controlling the passage of fluid to and from the cavity.

20. A method of disassembling a saddle having an inflatable panel, which comprises the steps of:

(i) deflating a saddle panel overlapping under and long flaps, the panel including an inflatable cavity with a valve for controlling the passage of fluid to and from the cavity, (ii) detaching the panel from a saddle seat portion, (iii) detaching the under flap and the long flap from the panel, (iv) separating the panel from the seat portion, and the under flap and long flap from the panel, and (v) flattening the panel, under flap, long flap, and seat portion for transportation.

21. A western saddle assembly comprising a seat portion, skirts detachably mounted to the seat portion, one skirt to each opposing side of the seat portion, and long fenders detachably secured one to each skirt, the skirts and fenders having cooperating fasteners for detachably securing the fenders to corresponding skirts, each skirt further including a cavity for receiving a filler material, the cavity having an access opening suitably configured for adding and removing the material therefrom, and fasteners across the opening for retaining the material in the cavity.

22. A western saddle assembly which comprises a seat portion, skirts detachably mounted to the seat portion, one skirt to each opposing side of the seat portion, and long fenders detachably secured to each skirt, the skirts and fenders having cooperating fasteners for detachably securing the fenders to corresponding skirts, each skirt further including an inflatable cavity with a valve for controlling the passage of fluid to and from the cavity.

23. A method of assembling a western saddle which comprises the steps of:

(i) providing a saddle seat portion, (ii) detachably securing skirts to opposing sides of the seat portion, one skirt to each side, (iii) detachably securing long fenders to the skirts, over an under flap, one fender to each skirt, the skirts each having front and rear faces, the rear face including fasteners for detachably mounting the skirt to the seat portion and the front face having fasteners for detachably securing the corresponding long fenders to the respective skirts, each skirt including a cavity for receiving a filler material, the cavity having an access opening suitably configured for adding and removing the material therefrom, and fasteners across the opening for retaining the material in the cavity.

24. A method of disassembling a western saddle which comprises the steps of:

(i) detaching fasteners securing an access opening in a saddle skirt, the opening leading to a cavity for receiving a filler material, the skirt underlying a long fender detachably secured thereto, (ii) removing the material from the cavity, (iii) detaching the skirt from a saddle seat portion, (iv) detaching the long fender from the skirt, (v) separating the skirt from the seat portion, and the long fender from the skirt, and (vi) flattening the panel, long fender, and seat portion for transportation.

* * * * *